US005396319A

United States Patent [19]

Tokuhashi et al.

[11] Patent Number: 5,396,319

[45] Date of Patent: Mar. 7, 1995

[54] CLEANING DEVICE FOR AN IMAGE FORMING APPARATUS

[75] Inventors: Masaki Tokuhashi, Yokohama; Makoto Arai; Masato Yanagida, both of Tokyo; Toshitaka Yamaguchi, Niiza; Hiroshi Ono, Yokohama, all of Japan

[73] Assignee: Ricoh Company, Ltd., Tokyo, Japan

[21] Appl. No.: 124,796

[22] Filed: Sep. 22, 1993

[30] Foreign Application Priority Data

Nov. 12, 1992 [JP] Japan ..... 4-301926

[51] Int. Cl.[6] ..... G03G 21/00

[52] U.S. Cl. ..... 355/299; 355/296

[58] Field of Search ..... 355/296, 297, 299, 301, 355/302

[56] References Cited

U.S. PATENT DOCUMENTS 4,519,699 5/1985 Mayer et al. ..... 355/301 X
4,577,955 3/1986 Mayer et al. ..... 355/299
4,640,608 2/1987 Higaya et al. ..... 355/299
4,702,591 10/1987 Tsuda et al. ..... 355/299
4,969,015 11/1990 Sanpe ..... 355/297
5,258,816 11/1993 Haneda ..... 355/296

*Primary Examiner*—A. T. Grimley
*Assistant Examiner*—Sandra L. Brase
*Attorney, Agent, or Firm*—Oblon, Spivak, McClelland, Maier & Neustadt

[57] ABSTRACT

A cleaning device for an image forming apparatus in which a shock generation device is provided for imparting an impact force to a cleaning blade in an axial direction of a photoconductive member in order to prevent an edge portion of the cleaning blade from accumulating debris such as minute paper powder and toner, and thereby maintain a high quality image. The cleaning device can be controlled so that operation of the shock generation device for providing an impact force to the cleaning blade starts simultaneously as revolution of a photoconductive member starts, such that the foreign materials are effectively removed from a cleaning blade.

22 Claims, 2 Drawing Sheets

(PRIOR. ART)

CLEANING DEVICE FOR AN IMAGE FORMING APPARATUS

BACKGROUND OF THE INVENTION

1. Field of the Invention

The present invention relates to a cleaning device for an electrophotographic image forming apparatus, such as printer, copying machine, facsimile machine, etc. More particularly, the invention relates to a cleaning device in an image forming apparatus having an improved cleaning blade arrangement.

2. Discussion of the Background

FIG. 1 is a schematic illustration showing a prior art image forming apparatus. In the image forming apparatus, a photoconductive member 1 is charged to a substantially uniform potential to sensitize its surface by a charger 2. An optical image to the surface of the photoconductive member 1 is applied from an optical system 3 for exposure to thereby form an electrostatic latent image thereon. Unnecessary charges on an area of the photoconductive member 1 such as an area corresponding to a location between a first recording paper and a second paper, or areas corresponding to sides or ends of the recording paper, wherein an image is not formed, are removed by an eraser 4. Thereafter, the latent image is developed by toner in a developing device 5 and the developed toner image is formed on the surface of the photoconductive member 1. The recording paper is supplied from a paper feeding cassette 45 by a feeding roller 46 and the recording paper is guided by guide plates 47. Furthermore, the recording paper is first stopped by registration rollers 48 and the recording paper which is synchronized with the toner image formed on the surface of the photoconductive member 1 is transported to a transfer portion. In the transfer portion, the recording paper is charged by corona discharge of a transfer charger 6 and the toner image formed on the surface of the photoconductive member 1 is transferred onto the recording paper. The charged recording paper is discharged by corona discharge of a separation charger 7 such that the electrostatically adhered recording paper is easily separated from the surface of the photoconductive member 1. Thereafter, the recording paper is guided by a guide plate 49 and is fed to a fixing device 51 by a transport member 50. The toner image formed on the recording paper is fixed by heat and pressure of the fixing device 51 and is discharged to a discharge tray 53 by a pair of discharge rollers 52. The residual toner, which has not contributed to the image transfer in the transfer process, on the surface of the photoconductive member 1 is removed by a cleaning device 9. After the toner removal, the photoconductive member 1 is discharged by corona discharge of a discharging charger (not shown) and is irradiated by light from an erase lamp 15 in order to be initialized electrostatically for repeated use.

FIGS. 2 and 3 show the prior art cleaning device 9 in detail. In the figures, reference numeral 8 indicates a charger which is located before or upstream of the cleaning device 9 and reference numeral 11 indicates a fur brush for cleaning which is disposed downstream of the charger 8 with respect to the rotational direction of the photoconductive member 1. The fur brush 11 includes conductive fibers provided on a surface of a rotation shaft 16 and a predetermined biasing voltage is applied to the conductive fibers by a bias roller 12 which is connected to a voltage source 59. The rotation shaft 16 is pivotally supported by housings 34, 37 and gear 17 is affixed to the rotation shaft 16, as shown in FIG. 3. The bias roller 12 (which is arranged in parallel and in contact with the fur brush 11) is connected with a power source, and pivotally supported by the housing 34. A gear 18 affixed to a rotation shaft of the bias roller 12 meshes with the gear 17. The fur brush 11 rotates in a clockwise direction in FIG. 2 by a motor (not shown). In this device, the toner and the surface of the photoconductive member 1 are passed by the corona discharge of the charger 8, and the polarity and voltage of the toner, and that of the photoconductive member 1 are controlled. When the remaining toner on the photoconductive member 1 passes by a seal 10 in the entrance side, the remaining toner is removed from the surface of the photoconductive member 1 by electrostatic adsorption and mechanical friction of the fur brush 11.

However, the fur brush 11 alone is not effective in removing all of the residual toner from the surface of the photoconductive member 1. The toner remaining after the fur brush 11 is scraped by mechanical friction of a cleaning blade 23, which is arranged downstream of the fur brush 11, and the toner falls on the fur brush 11. The fur brush 11 which caught the toner contacts with a flicker bar 24, thus generating vibrations in the fur brush 11. The toner is thereby separated from the fur brush 11 by the vibrations of the fur brush 11 and adhesion of the toner to the fur brush 11 is weakened. The remaining toner on the fur brush 11 is then attracted to the bias roller 12 which has a high biasing voltage applied thereto. The toner on the bias roller 12 is mechanically scraped down onto the housing 34 by a scraper 13, and the toner in a recess of the housing 34 is discharged to a predetermined location by a rotating discharge coil 14.

With reference to FIG. 2, details of the cleaning blade will now be described. FIG. 2 shows a condition in which the cleaning blade contacts the surface of the photoconductive member when a pressure solenoid is on. The cleaning blade 23 is affixed to a blade holder 32 and the blade holder 32 is connected to a blade bracket 25. In order to press or release the cleaning blade 23, one side of the blade bracket 25 is pivotally supported by a support lever 33. In addition, a middle portion of the blade bracket 25 is connected to an end of a bias spring 27 for urging the cleaning blade 23 against the surface of the photoconductive member 1, with the other end of the bias spring 27 affixed to the body of the apparatus. The blade bracket 25 is biased by the bias spring 27 to pivot in a clockwise direction in FIG. 2 on the support lever 33. As a result, the edge of the cleaning blade 23 comes in contact with the surface of the photoconductive member 1, and another side of the blade bracket 25 comes in contact with a release lever 28. One side of the release lever 28 is supported by a plunger 30 of a solenoid 29 for applying pressure to the release lever 28 and another side of the release lever 28 is connected with an end of a release spring 31. The other end of the release spring 31 is supported by the apparatus body. The tensile force provided by the release spring 31 is stronger than that of the bias spring 27 so that the release lever 28 is moved downward and the blade bracket 25 pivots in the counterclockwise direction to release the cleaning blade 23 from the surface of the photoconductive member 1 when the solenoid 29 is off.

As shown in FIG. 3, the support lever 33 is provided on one side of the blade holder 32 and an engaging portion 35 is formed on an end of the lever 33 located outside of the housing 34. A slot cam 38, which has a meandering slot, is affixed to the rotation shaft 16 of the fur brush 11, and the engaging portion 35 of lever 33 is controlled by the slot of the slot cam 38. The cleaning blade 23 is moved back and forth (as indicated by arrow 69) via blade holder 32, lever 33 and the engaging portion 35 as the slot cam 38 rotates corresponding to the rotation of the fur brush 11. At the same time, the edge of the cleaning blade 23 scrapes the surface of the photoconductive member 1. Even if a minute projecting part exists on the surface of the photoconductive member 1, the back and forth or reciprocating movement of the cleaning blade 23 prevents damage to the cleaning blade 23 which could result if the particular portion of the cleaning blade 23 repeatedly touches the small projecting part on the surface of the photoconductive member 1. Furthermore, minute paper pieces and toner piled up in the edge portion of the cleaning blade 23 are removed by the scraping action between the cleaning blade 23 and the photoconductive member 1. Currently the major purpose of the reciprocating movement of the cleaning blade 23 is the removal of accumulated paper powder and toner, since recently organic photoconductive members (which have a smooth surface and low hardness) have been widely used.

When the cleaning blade 23 is used over a long period of time, toner and other debris accumulate in the edge portions of the cleaning blade 23 which lifts up the cleaning blade 23 in that portion (or separates the blade 23 from the photoconductive member). This condition can lead to the undesirable possibility that the contact between the photoconductive member 1 and the cleaning blade 23 is insufficient and the residual toner on the surface of the photoconductive member 1 passes by the cleaning blade 23 without being removed from the surface of the photoconductive member 1. As a result, the quality of the image deteriorates. Furthermore, to accommodate needs for a high quality image, recently small diameter toner has been used, in which the fluidity of the toner is decreased, and the above mentioned problems can become very apparent.

SUMMARY OF THE INVENTION

It is, therefore, an object of the present invention to provide an improved cleaning device for an image forming apparatus, in which the above-mentioned conventional shortcomings are eliminated. More specifically, it is an object of the present invention to provide a cleaning device for an image forming apparatus which has an impact generation device for imparting an impact (or jolting) force to the cleaning blade in an axial direction of a photoconductive member, in order to prevent an edge portion of a cleaning blade from accumulating minute paper powder and toner, thereby maintaining a high quality image during copying.

It is another object of the present invention to provide a cleaning device for an image forming apparatus which is controlled so that operation of an impact generation device for impacting the cleaning blade starts simultaneously with the start of revolution of a photoconductive member such that the foreign materials are effectively removed from a cleaning blade during start-up of the operation of the image forming apparatus.

BRIEF DESCRIPTION OF THE DRAWINGS

Other objects, advantages and novel features of the present invention will become apparent from the following detailed description of the invention, particularly when considered in conjunction with the accompanying drawings in which.

DESCRIPTION OF THE PREFERRED EMBODIMENTS

Figure 4:
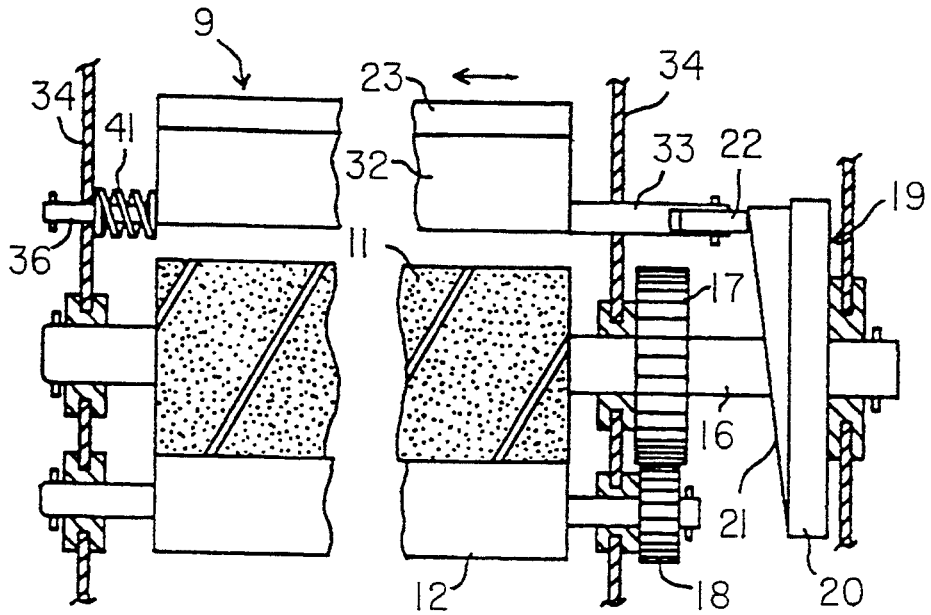
FIG. 4 is a schematic illustration of an embodiment of a cleaning device for an image forming apparatus according to the present invention.
Figure 2:
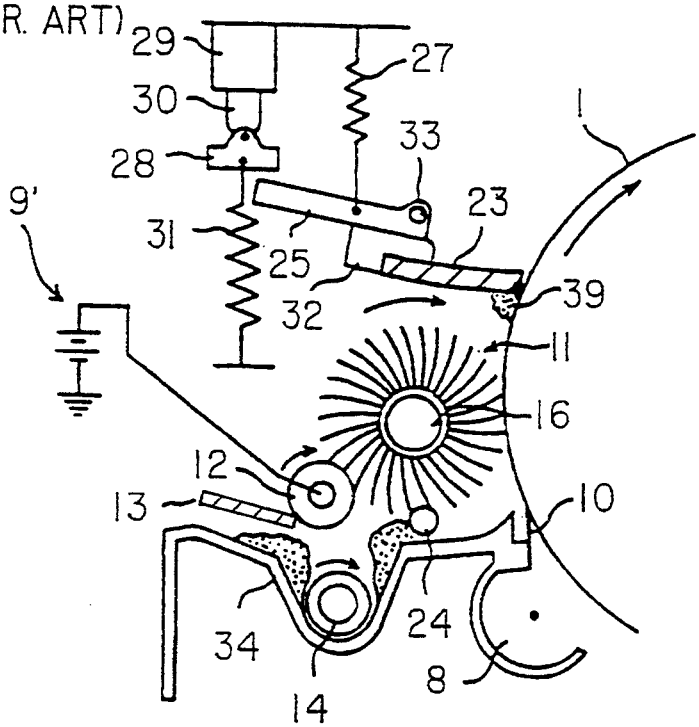
FIG. 2 is a schematic illustration of a conventional cleaning device.
Figure 3:
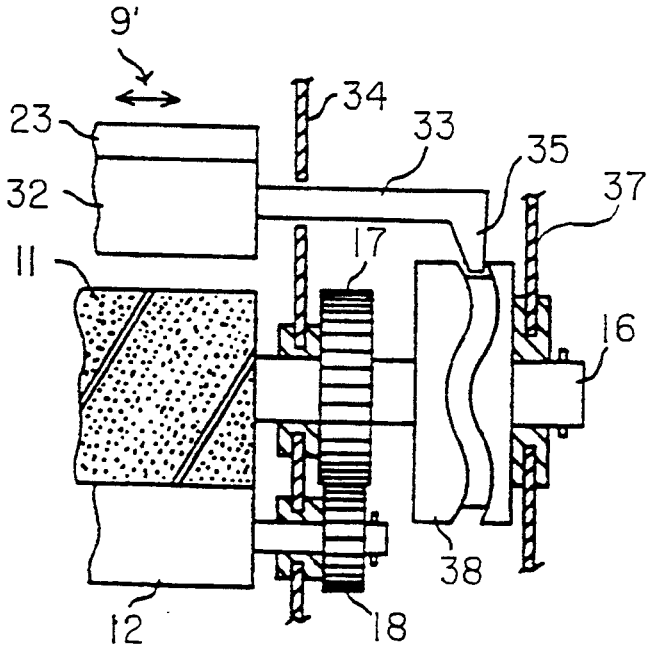
FIG. 3 (PRIOR ART)
FIG. 3 is a partial side view of the FIG. 2 arrangement.

A preferred embodiment of the present invention will now be described with reference to the drawings, wherein like reference numerals designate identical or corresponding parts through the several views. FIG. 4 shows a schematic illustration of a cleaning device for an image forming apparatus according to the present invention. In the figure, reference numeral 9 indicates a cleaning device for an image forming apparatus and reference numeral 11 indicates fibers provided on a surface of a rotating shaft 16, with a predetermined biasing voltage applied from the bias roller 12. The rotating shaft 16 is rotatably supported by a housing 34, with a gear 17 affixed to the rotating shaft 16. A bias roller 12, which is arranged in parallel and in contact with the fur brush 11 is rotatably supported by the housing 34. A gear 18 is affixed to the bias roller 12 and meshes with the gear 17 affixed to the shaft 16. A cleaning blade 23 is affixed to a blade holder 32 and the blade holder 32 is pivotally supported by supporting levers or members 33 and 36 on the housing 34 so as to press the cleaning blade 23 by a bias spring which urges the cleaning blade 23 against the surface of the photoconductive member 1. As in the FIG. 2 arrangement a solenoid is also provided to release the blade 23 from contact with the member 1. The residual toner (which has not contributed to the image in the transfer process) on the surface of the photoconductive member 1 is removed by a cleaning device 9, i.e., the residual toner is removed from the surface of the photoconductive member by electrostatic attraction and mechanical friction of the fur brush 11. Furthermore, the remaining toner on the surface of the photoconductive member 1 after the fur brush 11 is scraped by mechanical friction of the cleaning blade 23 arranged downstream from the fur brush 11, and the scraped toner falls on the fur brush 11. The fur brush 11 catches the toner, contacts a flicker bar, and as the contacting portion of the fur brush 11 passes over the flicker bar, vibrations are generated in the fur brush 11. The toner is thus separated from the fur brush 11 by the vibrations of the fur brush 11, or at least the adhesion of the toner to the fur brush 11 is weakened. The remaining toner on the fur brush 11 is then attracted to the bias roller 12, having a high bias voltage applied thereto by a power source. The toner on the bias roller 12 is mechanically scraped down onto the housing by a scraper and the toner in a recess of the housing is discharged to a predetermined location by rotation of a discharge coil, as in FIG. 2 arrangement.

Figure 5:
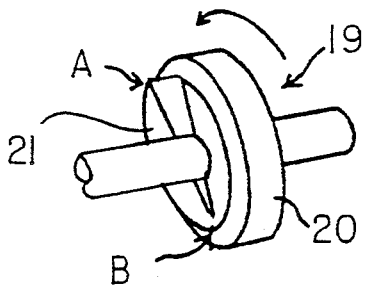
FIG. 5 is an illustration of a portion of the FIG. 4 assembly.
Figure 1:
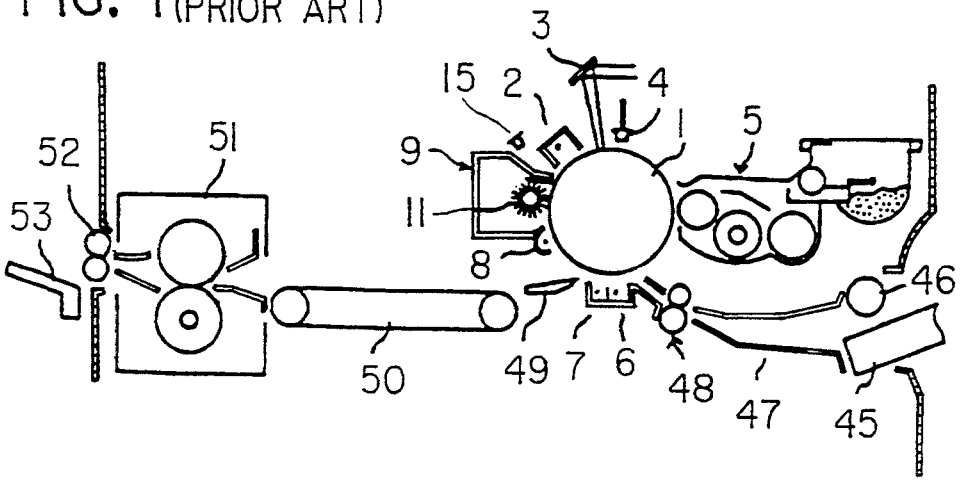
FIG. 1 (PRIOR ART)
FIG. 1 is a schematic illustration of a conventional image forming apparatus.

As shown FIGS. 4 and 5, a face cam 19 is affixed to the rotation shaft 16 of the fur brush 11. The face cam 19 has a substrate or base portion 20 and a cam face 21 of a semicircular shape which comprises a high-portion A and a low-portion B formed on the substrate portion 20. The support lever or arm 33 is provided on one side of the blade holder 32 and is movably supported at one side of the housing 34. A follower roller 22 is rotatably supported so as to face the cam face 21 at the end of the support lever 33. The supporting lever or arm 36 is provided on the other side of the blade holder 32 and is movably supported by another side of the housing 34. A spring 41 is provided upon the support 36 and between the blade holder 32 and the housing 34 such that the roller 22 is always urged against the cam face 21 by the spring 41.

During operation of the image forming apparatus, the cam rotates in the direction of the arrow corresponding to the rotation of the fur brush 11, as shown in FIG. 5 and the surface of the cam 19 which contacts with the surface of the follower roller 22 changes from the portion B of the cam face 21 to the high-portion A of the cam face 21. At the same time, the cleaning blade 23 is moved to the left in the axial direction of the photoconductive member 1 as shown in FIG. 4, against the force of the spring 41. Thereafter, the follower roller 22 drops rapidly from the high-portion A of the cam face 21 to the substrate portion 20, as the follower roller 22 passes over the high-portion A, such that the cleaning blade 23 is rapidly returned to the right with respect to an axial direction of the photoconductive member 1. As the follower roller 22 collides with the substrate portion 20, an impact or shock force is imparted to the cleaning blade 23 as a result of the impact or collision of the follower roller 22. As described above, the face cam 19, the follower roller 22 and the spring 41 constitute an impact generation device for impacting the cleaning blade 23 in an axial direction of the photoconductive member 1. The above-mentioned operations are repeated and the cleaning blade 23 is repeatedly moved back and forth and the cleaning blade 23 is periodically impacted or jarred. As a result, the toner which has accumulated at the edge portion of the cleaning blade 23 is easily removed.

In another embodiment, the cam 19 is further provided with a position detector (not shown) and the cam 19 is controlled such that the cam face 21 is stopped in the position where the high-portion A of the cam face 21 faces the follower roller 22. In this case, the foreign materials are more easily removed since a multiplicative effect is achieved, i.e., the cleaning blade 23 is immediately impacted in the axial direction of the photoconductive member 1 after starting (or restarting) of the revolution of the photoconductive member 1, and the photoconductive member 1 is rapidly accelerated in the revolution direction of the photoconductive member 1. The rapid acceleration of the photoconductive member 1 generates additional vibration or movement which contributes to the removal of the debris or foreign materials from the scrapper. As a position detector, a member which has a different reflectance from that of the cam 19, can be provided at a desired position of the cam 19. The position detection member on the cam 19 is sensed by a photo-sensor (not shown) and the revolution of the cam 19 can be stopped at a predetermined position.

It is to be understood that other impact producing devices may be utilized within the scope of the present invention. For example, an intermittently operating striking or shaking device may be utilized to provide a jarring force to the scrapper blade and thereby loosen or remove accumulated debris. In addition, an impact generating device may be utilized to impart an impact force to other portions of the image forming apparatus (e.g., the brush or other components) which tend to accumulate toner. Further, the jolting force need not necessarily be in the axial direction of the photoconductive member. However, the preferred arrangement described herein is particularly advantageous for at least the reasons that: (1) no additional driving systems are required to accomplish the impact cleaning operation; and (2) with the impact force in the axial direction of the photoconductive member there is less likelihood that the toner will fall onto the photoconductive member as it is shaken from the blade.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by letters patent of the United States is:

1. A cleaning device for an image forming apparatus in which a latent image is developed by toner, the cleaning device comprising:

a cleaning blade for removing residual toner on a surface of a toner carrying element, wherein said cleaning blade is supported to contact the toner carrying element and movable in an axial direction of the toner carrying element while being supported in contact with the toner carrying element; and an impact generation device imparting an impact force to said cleaning blade in said axial direction, said impact generation device including means for causing rapid movement of said cleaning blade in said axial direction followed by a haulting of movement in said axial direction to thereby generate said impact force.

2. The cleaning device as claimed in claim 1, wherein said impact generation device comprises:

a cam having a face;

force means for pressing said cleaning blade toward the face of said cam; and contact means for contacting the face of said cam.

3. The cleaning device as claimed in claim 2, wherein said contact means is a roller.

4. The cleaning device as claimed in claim 2, wherein said face of the cam includes a high-portion and a low-portion.

5. The cleaning device as claimed in claim 4, wherein said cam is controlled such that the cam face is stopped in a position at which the high-portion of the cam faces said contact means.

6. The cleaning device as claimed in claim 4, wherein said contact means is a roller.

7. The cleaning device as claimed in claim 2, wherein said force means and said contact means are supported by levers.

8. A cleaning device for an image forming apparatus, wherein a latent image is developed by toner in a developing device, comprising:

a cleaning blade for removing residual toner on the surface of a toner carrying element, wherein said cleaning blade is supported to contact the toner carrying element and for movement in an axial direction of the toner carrying element; and an impact generation device which imparts an impact force to said cleaning blade wherein said impact generation device immediately imparts an impact force to said cleaning blade upon the start of rotating movement of the toner carrying element;

said impact generation device including a cam having a face, force means for pressing said blade toward the face of said cam and contact means for contacting the face of said cam;

said face of said cam including a gradually inclined portion extending from a leastmost raised portion to a highly raised portion, said face further including a steeply inclined portion at a trailing end of said highly raised portion, wherein said cleaning blade moves axially as said contact means passes over said gradually inclined portion and said impact force is generated as said contact means passes over said steeply inclined portion.

9. The cleaning device as claimed in claim 8, wherein said contact means is a roller.

10. The cleaning device as claimed in claim 8, wherein said face of the cam includes a high-portion and a low-portion.

11. The cleaning device as claimed in claim 10, wherein said cam is controlled such that the cam face is stopped in a position at which the high-portion of the cam faces said contact means.

12. The cleaning device as claimed in claim 10, wherein said contact means is a roller.

13. The cleaning device as claimed in claim 8, wherein said force means and said contact means are supported by levers.

14. An image forming apparatus comprising:

a photoconductive member;

a developer device for applying developer to said photoconductive member;

a cleaning device; and an impact generating device for imparting an impact force to a portion of said cleaning device to jar said portion of said cleaning device and thereby loosen developer from said cleaning device and prevent undesired accumulation of developer and other debris;

wherein said cleaning device includes a rotating cleaning brush and a cleaning blade, and wherein said impact generating device includes a cam for subjecting said cleaning blade to said impact force, said cam including a face against which a follower is maintained in contact, said face including a first highly raised portion immediately followed by a second leastmost raised portion whereby said cleaning blade is subjected to said impact force as said follower passes from said first highly raised portion to said second leastmost raised portion.

15. The image forming apparatus of claim 14, wherein said cleaning blade is connected to said follower, and wherein a spring is provided for biasing said follower against said face of said cam.

16. The image forming apparatus of claim 14, wherein said cam is mounted for rotation with a shaft which rotates said cleaning brush.

17. The image forming apparatus of claim 14, further including means for positioning said cam such that said follower passes from said first portion to said second portion upon a starting operation such that the impact force provided by said cam and vibrations associated with the starting operation are combined to jar loose accumulated debris from the cleaning blade.

18. The image forming apparatus of claim 14, wherein said cleaning device includes a rotatable cleaning brush and a cleaning blade extending parallel to an axial direction of said cleaning brush, and wherein said impact generating device includes means for subjecting said cleaning blade to an impact force in a direction parallel to said axial direction.

19. The image forming apparatus of claim 14, wherein said impact generating device includes means for generating said impact force during a starting operation of said image forming apparatus such that vibrations associated with said starting operation are combined with said impact force to jar loose accumulated debris.

20. The image forming apparatus of claim 14, wherein said cam includes a connecting portion connecting said first highly raised portion and said second leastmost raised portion, and wherein said connecting portion extends substantially perpendicular to said second leastmost raised portion.

21. A cleaning device for an image forming apparatus in which a latent image is developed by toner upon a photoconductive member, the cleaning device comprising:

a first cleaning element extending in a longitudinal direction parallel to an axis of the photoconductive member, the cleaning element supported to contact at least one of the photoconductive member and a second cleaning element, said first cleaning element movable in said longitudinal direction while being supported in contact with said at least one of the photoconductive member and said second cleaning element; and an impact generation device imparting an impact force to said first cleaning element in said longitudinal direction, said impact generation device including means for causing rapid movement of said first cleaning element in said longitudinal direction followed by a haulting of movement in said longitudinal direction to thereby generate said impact force.

22. An image forming apparatus comprising:

a photoconductive member;

a developer device for applying developer to said photoconductive member;

a cleaning device; and an impact generating device for imparting an impact force to a portion of said cleaning device to jar said portion of said cleaning device and thereby loosen developer from said cleaning device and prevent undesired accumulation of developer and other debris;

wherein said cleaning device includes at least one of a rotating cleaning brush and a cleaning blade, and wherein said impact generating device includes a cam for subjecting said at least one of a rotating cleaning brush and a cleaning blade to said impact force, said cam including a face against which a follower is maintained in contact, said face including a first highly raised portion and a second leastmost raised portion, wherein said at least one of a rotating cleaning brush and a cleaning blade is subjected to said impact force as said follower passes from said first highly raised portion to said second leastmost raised portion.

* * * * *